US010309044B2

(12) United States Patent
Lonati et al.

(10) Patent No.: US 10,309,044 B2
(45) Date of Patent: Jun. 4, 2019

(54) METHOD FOR PROVIDING SEMI-FINISHED TUBULAR MANUFACTURED ARTICLES TO BE CLOSED BY STITCHING AT AN AXIAL END THEREOF FOR THE PRODUCTION OF SOCKS, AND SEMI-FINISHED TUBULAR MANUFACTURED ARTICLE OBTAINED WITH THE METHOD

(71) Applicant: LONATI S.P.A., Brescia (IT)

(72) Inventors: Ettore Lonati, Botticino (IT); Fausto Lonati, Brescia (IT); Francesco Lonati, San Felice del Benaco (IT)

(73) Assignee: LONATI S.P.A., Brescia (IT)

( * ) Notice: Subject to any disclaimer, the term of this patent is extended or adjusted under 35 U.S.C. 154(b) by 32 days.

(21) Appl. No.: 15/544,726

(22) PCT Filed: Jan. 27, 2016

(86) PCT No.: PCT/EP2016/051625
§ 371 (c)(1),
(2) Date: Jul. 19, 2017

(87) PCT Pub. No.: WO2016/120293
PCT Pub. Date: Aug. 4, 2016

(65) Prior Publication Data

US 2018/0002844 A1 Jan. 4, 2018

(30) Foreign Application Priority Data

Jan. 28, 2015 (IT) ..... MI2015A0108

(51) Int. Cl.
*D04B 1/26* (2006.01)
*D04B 1/10* (2006.01)
(Continued)

(52) U.S. Cl.
CPC ..... *D04B 1/26* (2013.01); *D04B 1/108* (2013.01); *D04B 1/12* (2013.01); *D04B 15/14* (2013.01);
(Continued)

(58) Field of Classification Search
CPC ..... D04B 9/53; D04B 1/26; D04B 1/108
See application file for complete search history.

(56) References Cited

U.S. PATENT DOCUMENTS

RE24,971 E * 4/1961 Getaz ..... D05B 7/00 112/27
2,980,917 A * 4/1961 Slane ..... D05B 23/009 112/475.09
(Continued)

FOREIGN PATENT DOCUMENTS

CN 1079518 A 12/1993
EP 0889153 1/1999
(Continued)

OTHER PUBLICATIONS

International Search Report related to PCT/EP2016/051625, dated Jan. 3, 2016 (2 pgs.).
(Continued)

*Primary Examiner* — Danny Worrell
(74) *Attorney, Agent, or Firm* — Husch Blackwell LLP

(57) ABSTRACT

A method for providing semi-finished tubular manufactured articles to be closed by stitching at an axial end thereof for the production of socks, comprising a step of providing the body of the tubular manufactured article and a step of providing an end portion of the tubular manufactured article which comprises: —a step of providing an intermediate band connected to the body of the manufactured article and thinner than the thickness at least of the rows of knitting of the body of the manufactured article which are connected to
(Continued)

the intermediate band; —a step of providing an end edge thicker than the thickness of the intermediate band; the height of the intermediate band, proximate to the regions that constitute the lateral ends of the two flaps of the end portion to be overlapped in order to stitch the axial end to be closed of the tubular manufactured article, is lower than the height of the remaining part of the intermediate band.

9 Claims, 8 Drawing Sheets

(51) Int. Cl.
*D04B 1/12* (2006.01)
*D04B 15/14* (2006.01)
*D04B 15/32* (2006.01)

(52) U.S. Cl.
CPC ..... *D04B 15/32* (2013.01); *D05D 2305/00* (2013.01)

(56) References Cited

U.S. PATENT DOCUMENTS 3,324,686 A * 6/1967 Rosenstein ..... A41B 11/00 2/239
5,398,626 A 3/1995 Rosso et al.
5,437,238 A * 8/1995 Price ..... D05B 33/00 112/153
5,522,332 A * 6/1996 Price ..... D05B 33/00 112/306
5,562,060 A * 10/1996 Price ..... D05B 33/00 112/272
5,570,647 A * 11/1996 Adamski, Jr. ..... D05B 33/00 112/153
6,158,254 A * 12/2000 Richard ..... A41B 11/005 2/239
6,209,363 B1 * 4/2001 Jordan ..... D04B 1/26 66/187
7,437,896 B2 * 10/2008 Hirao ..... A41B 11/00 2/239
8,156,768 B2 * 4/2012 Green ..... A41B 11/01 66/178 R
9,957,649 B2 * 5/2018 Liu ..... D04B 1/26

FOREIGN PATENT DOCUMENTS

EP 1473399 11/2004
WO 2002084003 10/2002

OTHER PUBLICATIONS

Search Report related to Italian priority claim MI2015A000108, dated Jul. 10, 2015 (2 pgs.).
Chinese Search Report for Appln No. 201680007481.6.

* cited by examiner

METHOD FOR PROVIDING SEMI-FINISHED TUBULAR MANUFACTURED ARTICLES TO BE CLOSED BY STITCHING AT AN AXIAL END THEREOF FOR THE PRODUCTION OF SOCKS, AND SEMI-FINISHED TUBULAR MANUFACTURED ARTICLE OBTAINED WITH THE METHOD

The present invention relates to a method for providing semi-finished tubular manufactured articles to be closed by stitching at an axial end thereof for the production of socks, and a semi-finished tubular manufactured article obtained with the method.

As is known, one of the techniques for the production of socks consists in executing a tubular manufactured article by way of a circular hosiery machine, taking the tubular manufactured article, which is open at both of its axial ends, from such machine and subsequently sending such tubular manufactured article to a sewing machine, with which the closing is executed of one axial end of the tubular manufactured article, which constitutes the toe of the sock, thus completing the production of the manufactured article and that is to say obtaining the finished sock.

Usually, the sewing machine is provided, at its inlet point, with a feeding guide constituted by two blades arranged mutually side by side in a substantially horizontal plane so that, between these two blades, a passage is defined which is intended to receive the semi-finished tubular manufactured article to be completed by stitching one of its axial ends. The semi-finished tubular manufactured article is inserted, after having flattened it by bringing together the two halves of the rows of knitting arranged proximate to the axial end to be closed, between these two blades, so that it protrudes with its end portion, which constitutes the axial end to be closed by stitching, above the two blades, where means are provided for gripping and advancement which engage with this end portion and entrain the tubular manufactured article along the passage between the two blades, bringing it to be subjected to the action of a sewing head.

In more detail, the semi-finished tubular manufactured articles that are intended to be closed by stitching at an axial end thereof are made with one end portion especially created at such axial end in order to facilitate the stitching operation and in order to obtain a sock that is fully satisfactory both aesthetically and functionally. This end portion is usually comprised of an intermediate band, which constitutes an axial extension of the body of the manufactured article and is thinner than the thickness of the rows of knitting of the body of the manufactured article which border such intermediate band, and of an end edge, which is thicker than the thickness of the intermediate band.

The semi-finished tubular manufactured article is inserted between the two blades of the feeding guide so that it rests, by way of the end edge, on the upper face of the two blades and dangles below these. The two blades, on their mutually facing sides, each have a plate that, starting from the upper face of the blades, extends along an inclined plane in the direction of their lower face. During the advancement of the tubular manufactured article along the feeding guide, the boundary region between the body of the manufactured article and the intermediate band engages against the lower side of this plate and the advancement of the tubular manufactured article causes the tensioning of the intermediate band which is conveniently made with an elastically extensible thread. This ensures that the row of knitting of the body of the manufactured article which borders the intermediate band is correctly positioned proximate to the lower side of the two blades where the sewing head of the sewing machine operates which, in this manner, executes the stitching, with high precision, right at this row of knitting, operating the closing of the axial end of the tubular manufactured article that constitutes the toe of the sock with a quality that is very close to the quality obtainable with a linking operation. During the stitching operation, the intermediate band and the end edge are progressively removed by way of cutting carried out at the first row of knitting of the intermediate band which is connected to the row of knitting of the body of the manufactured article affected by the stitching.

This production technique for socks, in the last decade, has been increasingly replaced by techniques in which it is possible to execute the closing of the toes of socks directly on the production machine or on a stitching unit arranged laterally to the production machine and served by a device that automatically transfers the tubular manufactured article from the knitting head of the production machine to the stitching unit. The latter production techniques are becoming increasingly widespread owing to the fact that they do not require manual intervention in order to send the semi-finished tubular manufactured articles to the sewing machine, with which the closing of the toes of the socks is carried out. Furthermore, most of these production techniques make it possible to execute the stitching by perfectly coupling the loops of knitting to be joined and therefore obtaining a result that is practically identical to that obtainable with a linking operation.

However, the production technique for socks described above, which involves taking a semi-finished tubular manufactured article from the production machine and subsequently feeding it into a sewing machine between the two blades of a feeding guide of the type described above, is still widely used.

This production technique for socks, with reliability consolidated over decades of use, suffers the drawback that it produces fully satisfactory stitching results only if the provision of the end portion of the semi-finished tubular manufactured article, intended to be engaged with the feeding guide of the sewing machine, is practically perfectly carried out and the feeding guide of the sewing machine is adjusted correctly.

Otherwise, as can often happen, the stitching can affect, instead of the row of knitting of the body of the manufactured article which borders the intermediate band, a row of knitting of the intermediate band or a portion thereof, leading to a result that is not fully satisfactory in terms both of appearance and of comfort for the user.

One of the stitching defects that is most often encountered is constituted by a stitching that correctly affects the row of knitting of the body of the manufactured article which borders the intermediate band for almost the entire extension thereof except for the regions located proximate to the lateral ends of the two flaps of the axial end of the tubular manufactured article which are mutually overlapped laterally prior to being inserted between the two blades of the feeding guide of the sewing machine. In essence, the tubular manufactured article, during its advancement along the feeding guide of the sewing machine, tends to detach, with these lateral ends, from the lower side of the two blades of the feeding guide.

In order to overcome this drawback, it is possible to bring the two blades closer together, thus reducing the width of the passage available for the intermediate band in order to prevent this from protruding from the lower side of the blades and/or making the intermediate band with an elastic thread that is more tensioned. However, a contrivance of this type makes it difficult to insert the tubular manufactured article between the two blades, and it can have the consequence of retaining, between the two blades, a portion of the body of the tubular manufactured article which would be cut at the end of the stitching, together with the intermediate band, thus leading to an unsatisfactory result.

The aim of the present invention is to solve the above mentioned drawback, by devising a method for providing semi-finished tubular manufactured articles for the production of socks with this technique which makes it possible to obtain a completely satisfactory result of closing of the toes of socks, while leaving a comfortable margin of tolerance for the production of the semi-finished tubular manufactured article and the adjustment of the feeding guide of the sewing machine.

Within this aim, an object of the invention is to provide a method that can be carried out without requiring modifications either of the circular hosiery machine used for the production of the semi-finished tubular manufactured article or of the sewing machine used subsequently for executing the closing of the toes of socks.

Another object of the invention is to provide a method that, by not requiring continual adjustments of the feeding guide of the sewing machine, simplifies and speeds up the operation to close the toes of socks and therefore makes it possible to increase the productivity of the production lines used.

This aim and these and other objects which will become better apparent hereinafter are achieved by a method for providing semi-finished tubular manufactured articles to be closed by stitching at an axial end thereof for the production of socks, which comprises a step of providing the body of a tubular manufactured article and a step of providing an end portion of the tubular manufactured article which is intended to be removed during the subsequent stitching operation in order to close an axial end of the tubular manufactured article, said step of providing the end portion comprising:

a step of providing an intermediate band connected to said body of the manufactured article and thinner than the thickness at least of the rows of knitting of the body of the manufactured article which are connected to said intermediate band;

a step of providing an end edge thicker than the thickness of said intermediate band;

characterized in that the height of said intermediate band, proximate to the regions that constitute the lateral ends of the two flaps of said end portion to be overlapped in order to stitch the axial end to be closed of the tubular manufactured article, is lower than the height of the remaining part of said intermediate band.

Further characteristics and advantages of the invention will become better apparent from the description of a preferred, but not exclusive, embodiment of the method according to the invention, which is illustrated by way of non-limiting example in the accompanying drawings wherein:

FIG. 1 schematically illustrates a portion of a semi-finished tubular manufactured article at an axial end thereof that is intended to be engaged with a feeding guide of a sewing machine for executing the closing of such axial end of the semi-finished tubular manufactured article;

Figure 1:
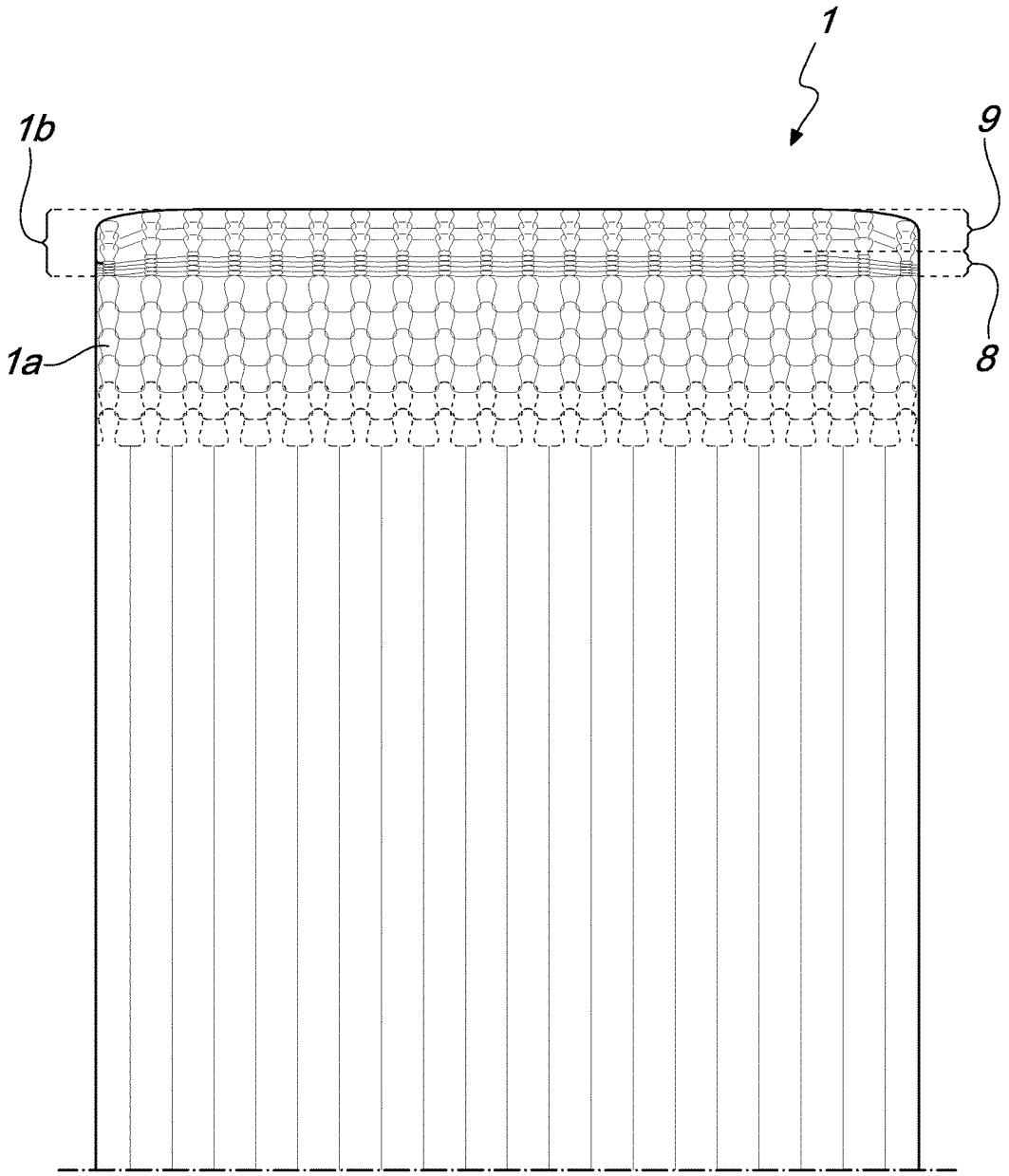

With reference to the figures, the semi-finished tubular manufactured article which is obtained with the method according to the invention is generally designated by the reference numeral 1.

Figure 2:
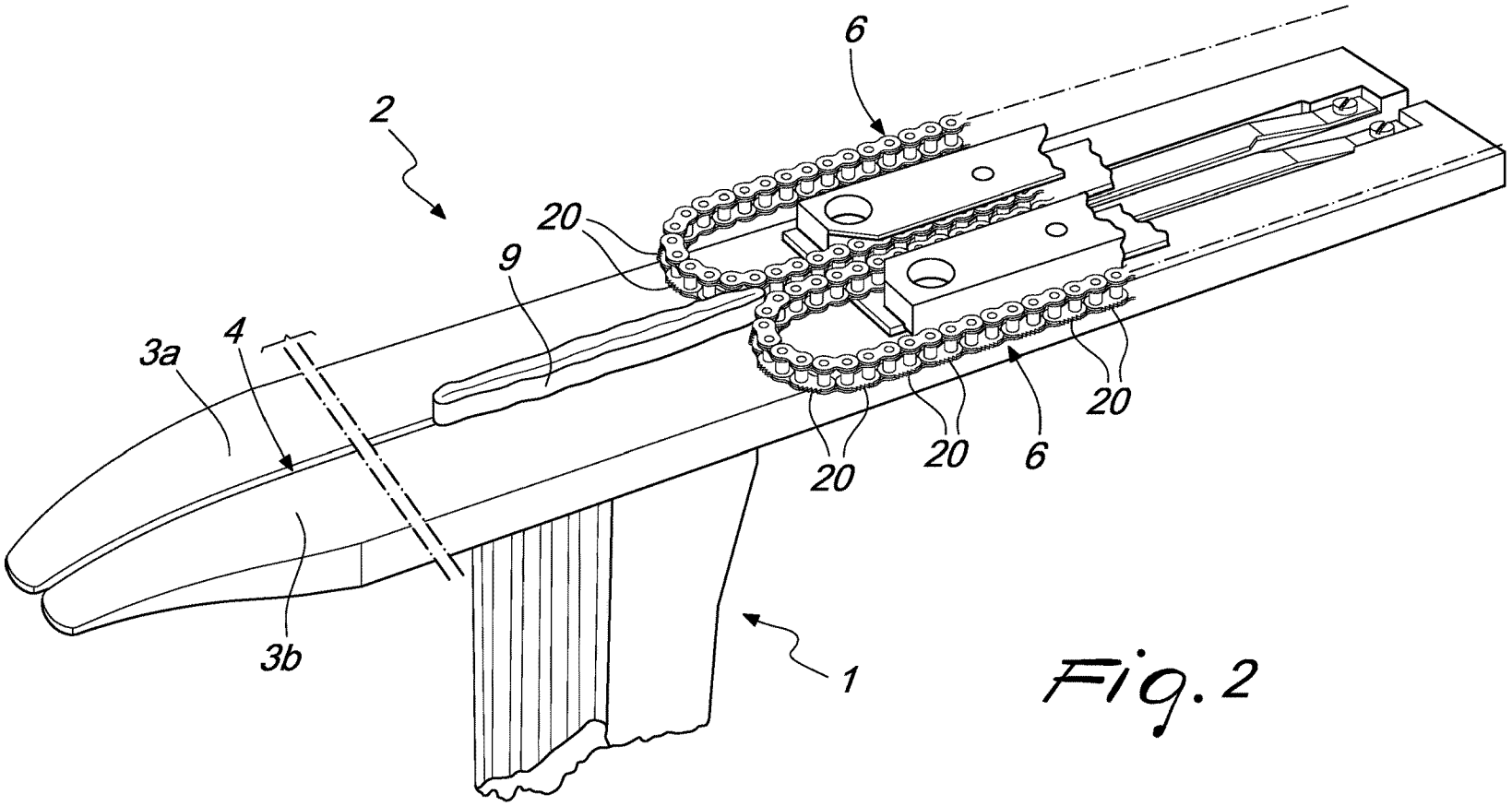
FIG. 2 is a schematic perspective view of a feeding guide of a sewing machine for executing the closing of one axial end of semi-finished tubular manufactured articles with a semi-finished tubular manufactured article, produced by way of the method according to the invention, inserted between the two blades of the feeding guide.
Figure 3:
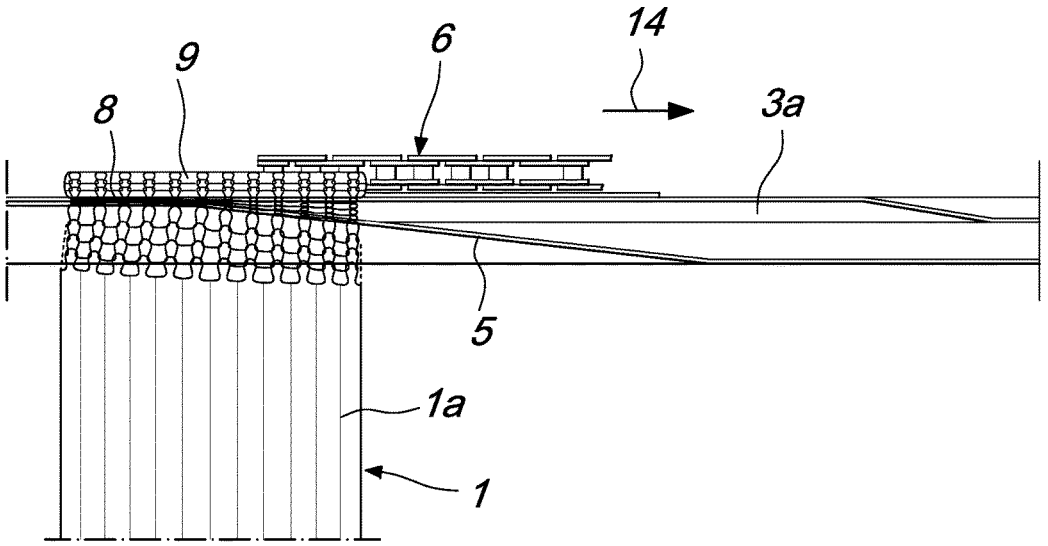
FIGS. 3 and 4 are schematic cross-sectional views, taken along a central plane passing between the two blades of the feeding guide shown in FIG. 2, of the advancement along the feeding guide of the semi-finished tubular manufactured article obtained with the method according to the invention.
Figure 4:
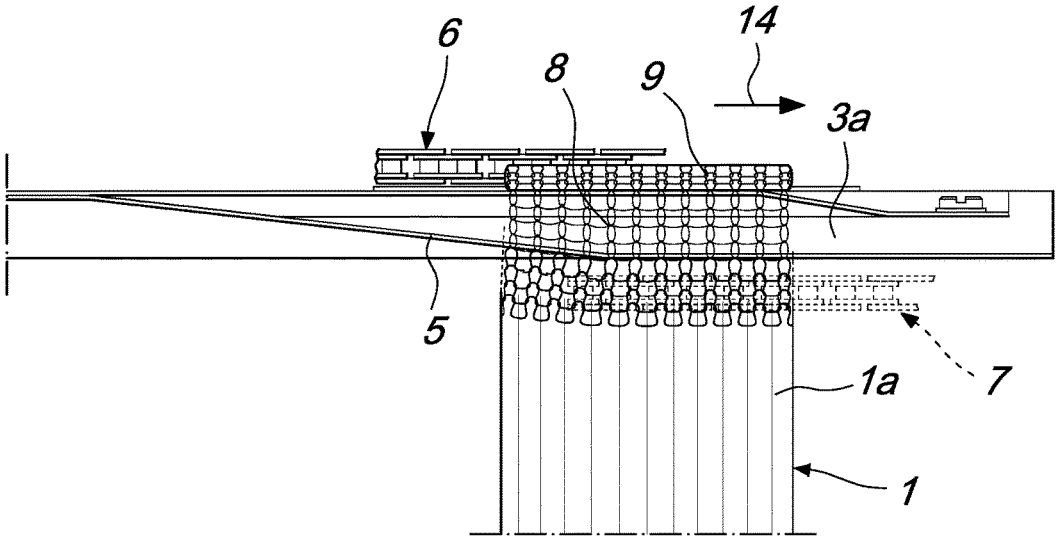

FIGS. 2 to 4 show the feeding guide 2 of a conventional sewing machine which comprises two blades 3*a*, 3*b* arranged mutually side by side on a substantially horizontal plane so that, between them, a passage 4 is defined in which the semi-finished tubular manufactured article 1 to be subjected to stitching is inserted.

On each of the mutually facing sides of the blades 3*a*, 3*b*, which laterally delimit the passage 4, there is a plate 5 which extends, with one of its inclined portions, from the upper face to the lower face of the corresponding blade.

Above the two blades 3*a*, 3*b* and below the two blades 3*a*, 3*b* there are means for gripping and advancement which can engage the tubular manufactured article 1 and which can be actuated so as to entrain the tubular manufactured article 1 along the passage 4. In the feeding guide 2 shown, these means for advancement, which are shown only schematically, are constituted by pairs of chains 6, 7 which are arranged mutually side by side along the passage 4 and are made up of links provided with claws 20 which can engage a portion of the tubular manufactured article 1 which protrudes above or below the blades 3*a*, 3*b*.

The method according to the invention comprises a step of providing the body of the tubular manufactured article, designated with the reference numeral 1*a*, and a step of providing an end portion 1*b* of the tubular manufactured article 1 which is intended to be removed during the subsequent stitching operation in order to close an axial end of the tubular manufactured article 1.

This step of providing of the end portion 1*b* comprises a step of providing an intermediate band 8 which is connected to the body 1*a* of the manufactured article and is thinner than the thickness of the rows of knitting of the body 1*a* of the manufactured article, at least with regard to the rows of knitting of the body 1*a* of the manufactured article adjacent to the intermediate band 8.

The step of providing the end portion 1*b* also comprises a step of providing an end edge 9 with a thickness that is thicker than the thickness of the intermediate band 8.

According to the invention, the height of the intermediate band 8 proximate to the regions that constitute the lateral ends of the two flaps of the intermediate band 8 to be flattened and paired in order to execute the stitching of the axial end to be closed of the tubular manufactured article 1 is lower than the height of the remaining part of the intermediate band 8.

More specifically, the intermediate band 8 is produced by providing some rows of knitting in succession, which can be equal in number to the number of rows of knitting usually provided in making intermediate bands in conventional methods, with the contrivance of making the loops of knitting 10, which are located proximate to the regions that constitute the lateral ends of the two flaps of the intermediate band 8 to be overlapped laterally i.e. to be paired and flattened in order to stitch the axial end to be closed of the tubular manufactured article 1, shorter than the length of the loops of knitting 11 of the same rows of knitting in the remaining part of the intermediate band 8, as shown in particular in FIGS. 5 to 9.

The different length of the loops of knitting 10 of the intermediate band 8 which are located proximate to the lateral ends of the two flaps of the intermediate band 8 to be paired can be obtained by suitably actuating, in a way that is known per se, the devices for varying the density of the knitting which are provided on practically all circular hosiery machines currently on the market. These are devices that move the transfer cam parallel to the axis of the needle cylinder relative to the complex of cams for actuating the needles, so as to vary the extent of the descent of the needles inside the needle cylinder after these have taken up the thread supplied to them at a feed or drop of the machine during the formation of loops of knitting. As a consequence of this movement of the transfer cam, the needles form loops of knitting of greater or lesser length, as is well known to the person skilled in the art. The movement of the transfer cam and therefore the variation of the length of the loops of knitting at determined regions of the tubular manufactured article during its formation, in modern circular hosiery machines, can be inserted, according to the various requirements, in electronic programs for actuating the machine.

Preferably, the intermediate band 8 is made with an elastically extensible thread, for example a nylon thread.

The intermediate band 8 is preferably made with a thread that has a smaller diameter than the diameter of the thread or of the group of threads used to provide the rows of knitting of the body 1*a* of the manufactured article which are connected to the intermediate band 8 and that is to say which border them.

Preferably, the tubular manufactured article 1 is produced by beginning its production from its opposite axial end from the axial end to be closed, at which the end portion 1*b* with the intermediate band 8 and the end edge 9 is provided.

Operation to close the axial end of the semi-finished tubular manufactured article 1 made with the method described above is executed as follows.

The axial end of the tubular manufactured article 1 which is provided with the intermediate band 8 and with the end edge 9 is flattened by overlapping and pairing the two flaps that make it up so that the regions of the intermediate band 8 which have a shorter height are at the lateral ends of the end portion 1*b*.

Figure 5:
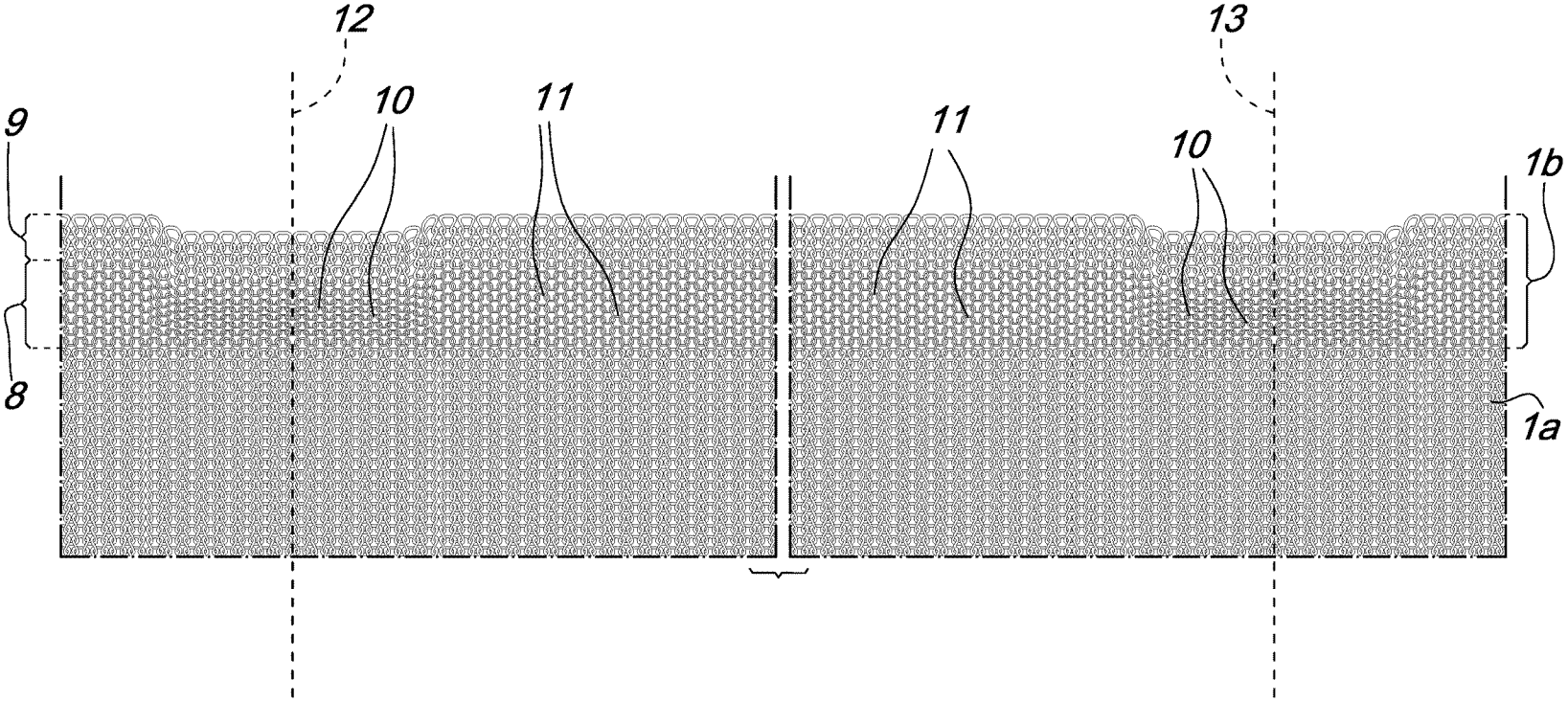
FIG. 5 is a schematic view of a portion, enlarged and laid flat, of the semi-finished tubular manufactured article obtained with the method according to the invention, proximate to its end portion intended to be engaged with the feeding guide of the sewing machine.
Figure 6:
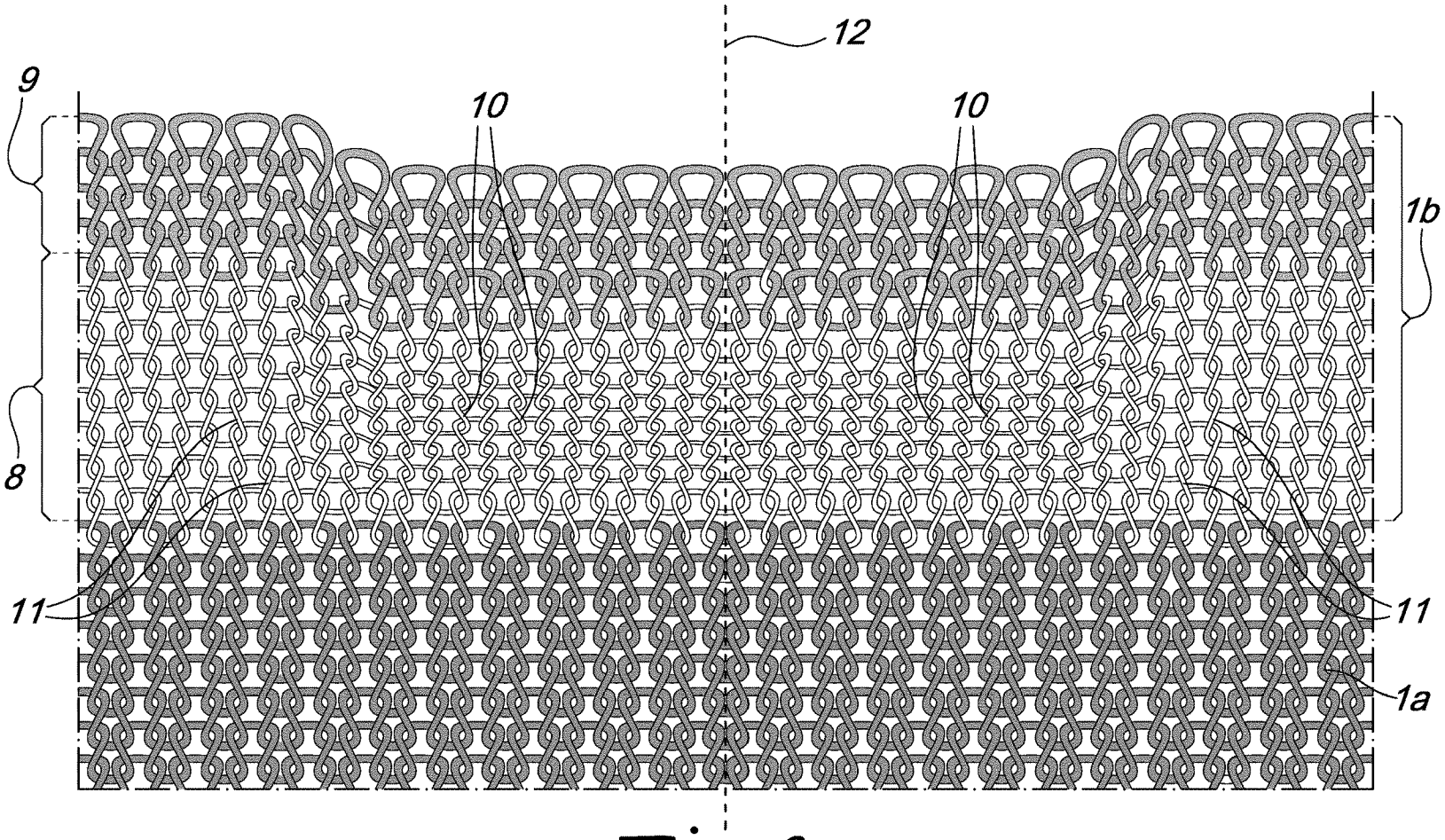
FIG. 6 is an enlarged detail of FIG. 5.
Figure 7:
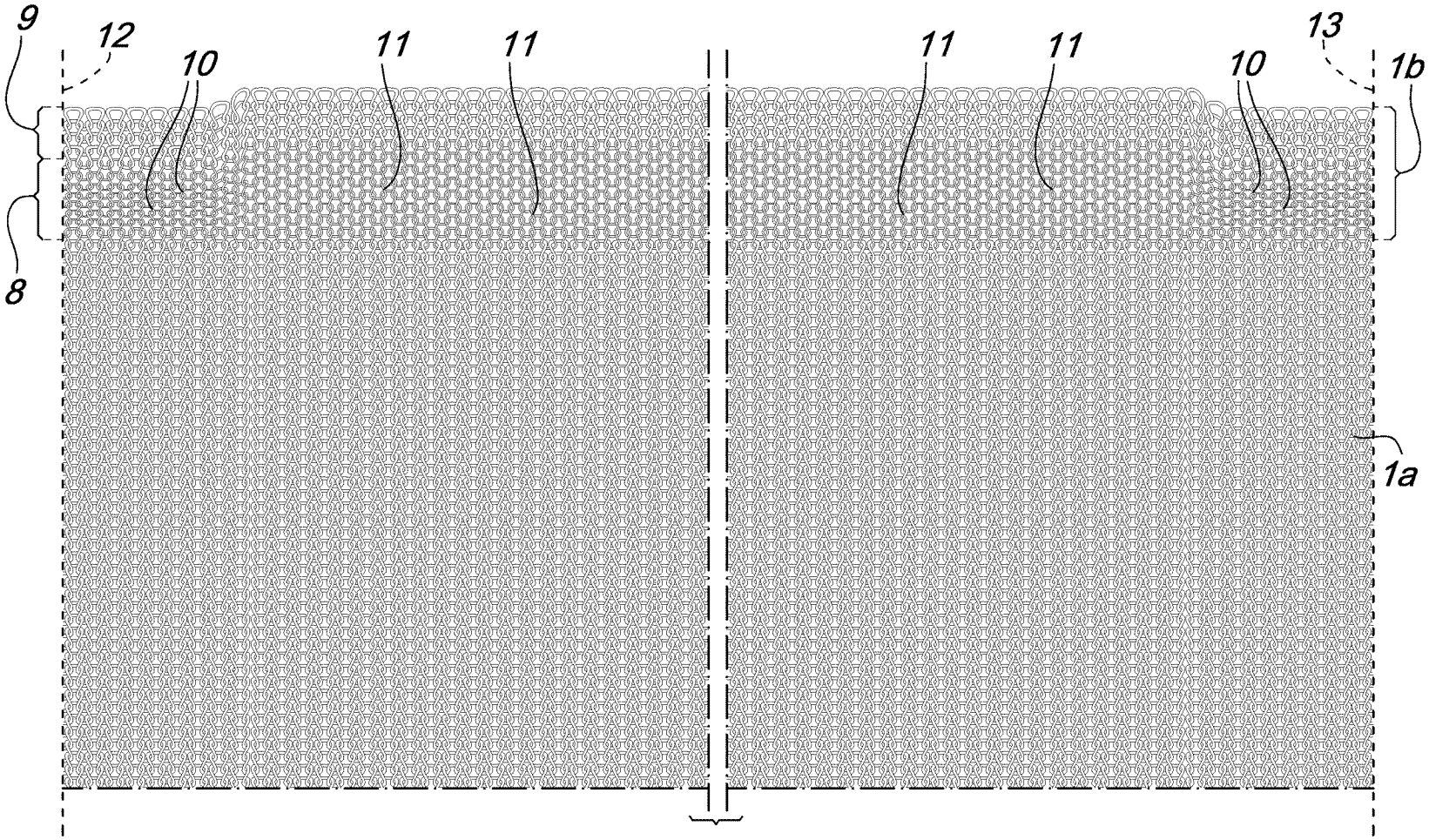
FIG. 7 is a view of one of the two flaps of the end portion of the tubular manufactured article which are mutually paired and flattened prior to being inserted into the feeding guide in FIG. 2.
Figure 8:
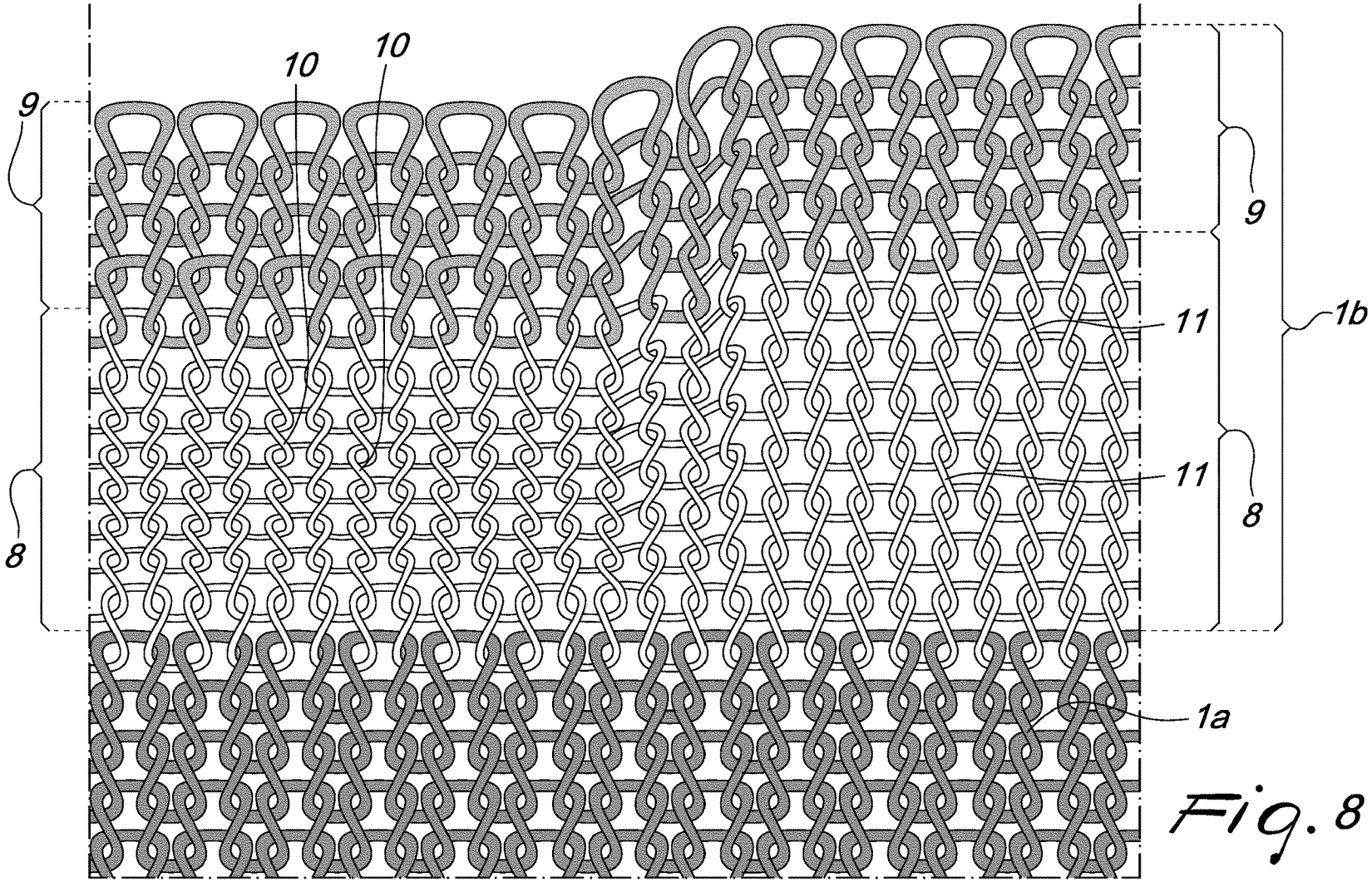
FIG. 8 is an enlarged detail of FIG. 7.
Figure 9:
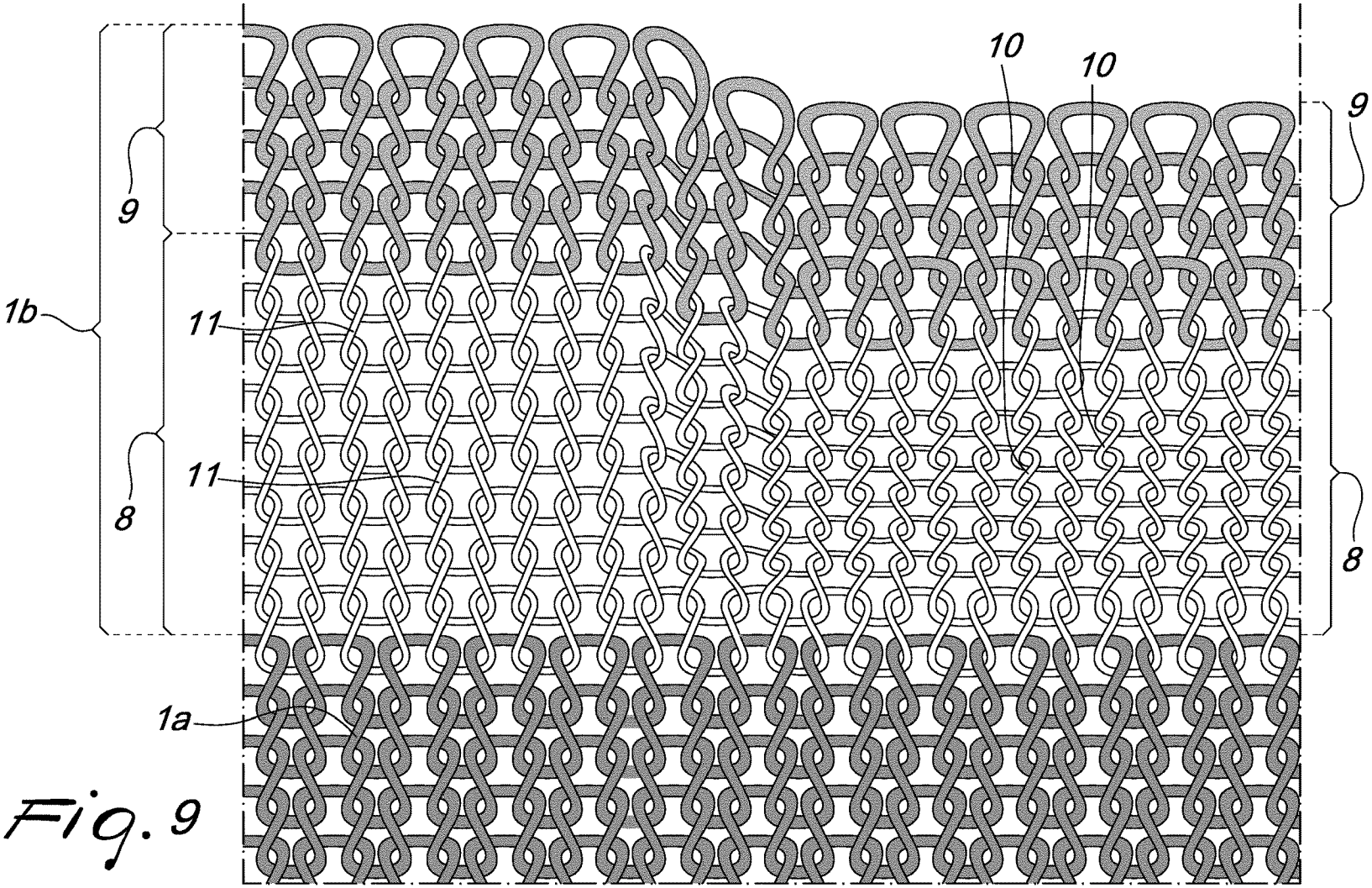
FIG. 9 is another enlarged detail of FIG. 7.

In FIGS. 5 and 7, two dotted lines 12 and 13 indicate the lines along which the two flaps of the tubular manufactured article 1, which need to be joined in order to close the axial end thereof, are folded and overlapped.

The end portion 1*b*, thus flattened, is inserted in the passage 4 defined between the two blades 3*a*, 3*b* so that the end edge 9 rests on the upper face of the two blades 3*a*, 3*b* and so that the start of the body 1*a* of the manufactured article which borders the intermediate band 8 is in the passage 4 below the plates 5 which, at the start of the passage 4, are at the level of the upper face of the blades 3*a*, 3*b*, as illustrated in FIG. 2.

The end edge 9 of the tubular manufactured article 1 is gripped by the pair of chains 6 which cause its progressive advancement along the passage 4 according to the direction indicated by the arrow 14. This advancement, owing to the fact that the plates 5, against the lower face of which the start of the body 1*a* of the manufactured article engages, descend progressively toward the lower face of the blades 3*a*, 3*b*, causes the tensioning, parallel to the axis of the tubular manufactured article 1, of the intermediate band 8 and brings the body 1*a* of the manufactured article below the blades 3*a*, 3*b*, as shown in FIGS. 3 and 4.

More specifically, following the advancement of the tubular manufactured article 1 along the passage 4, the first row of knitting of the body 1*a* of the manufactured article, from which the intermediate band 8 extends, will be arranged against the lower face of the blades 3*a*, 3*b* and it will be this row of knitting that will be affected by the stitching.

The tubular manufactured article 1 is then engaged by the pair of chains 7 arranged below the two blades 3*a*, 3*b* which further entrain the tubular manufactured article 1 along the direction 14 so that it is stitched by a sewing head, which is conventional and not shown for the sake of simplicity. The stitching is carried out along the first row of knitting of the body 1*a* of the manufactured article. During the stitching, the tubular manufactured article 1 is cut along the first row of knitting of the intermediate band 8.

In this manner, the axial end of the tubular manufactured article 1, which constitutes the toe of the sock, is closed and the end portion, which has been used for stitching, is removed, thus obtaining the finished sock.

It should be noted that the shorter height of the intermediate band 8 in the regions located proximate to the lateral ends of the tubular manufactured article 1 prevents, during the advancement of the tubular manufactured article 1 between the blades 3*a*, 3*b*, these regions from protruding below the blades 3*a*, 3*b* and therefore it prevents the stitching from affecting portions of the intermediate band 8. In this manner, it is possible to obtain a correct stitching without having to resort to excessive reductions of the width of the passage 4 and without having to pretension the thread with which the intermediate band 8 is provided.

In practice it has been found that the method according to the invention fully achieves the set aim in that it makes it possible to obtain a completely satisfactory result of closing of the toes of socks, without requiring high precision in providing the end portion of the semi-finished tubular manufactured article to be engaged with the feeding guide of the sewing machine, or in adjusting the feeding guide of the sewing machine.

The method, thus conceived, is susceptible of numerous modifications and variations, all of which are within the scope of the appended claims. Moreover, all the details may be substituted by other, technically equivalent elements.

In practice the materials employed, and the dimensions, may be any according to requirements and to the state of the art.

The disclosures in Italian Patent Application No. MI2015A000108 (102015902324061) from which this application claims priority are incorporated herein by reference.

The invention claimed is:

1. A method for providing semi-finished tubular manufactured articles to be closed by stitching at an axial end thereof for a production of socks, which comprises a step of providing a body of a tubular manufactured article and a step of providing an end portion of the tubular manufactured article which is intended to be removed during a subsequent stitching operation in order to close an axial end of the tubular manufactured article, said step of providing the end portion comprising:

a step of providing an intermediate band connected to said body of the manufactured article;

a step of providing an end edge thicker than the thickness of said intermediate band;

wherein a height of said intermediate band, proximate to regions that constitute lateral ends of two flaps of said end portion to be overlapped in order to stitch the axial end to be closed of the tubular manufactured article, is lower than a height of a remaining part of said intermediate band.

2. The method according to claim 1, wherein said intermediate band is produced by providing rows of knitting in succession; a plurality of loops of knitting of at least part of said rows of knitting of the intermediate band, proximate to the regions constituting the lateral ends of the two flaps of said end portion are overlapped laterally and stitch the axial end to be closed of the tubular manufactured article, being shorter than a length of loops of knitting of the same rows of knitting in the remaining part of said intermediate band.

3. The method according to claim 2, wherein said intermediate band is made of an elastically extensible thread.

4. The method according to claim 2, wherein said intermediate band is made of a second thread that has a smaller diameter than a diameter of a first thread or of a group of first threads used to provide the rows of knitting of the body of the manufactured article which are connected to said intermediate band.

5. The method according to claim 2, wherein the provision of the tubular manufactured article is begun from an axial end of the tubular manufactured article that is opposite with respect to the axial end to be closed by stitching.

6. A semi-finished tubular manufactured article for a production of socks, which comprises a body of the manufactured article and an end portion of the tubular manufactured article which is connected to an axial end of said body of the manufactured article and is intended to be removed during a subsequent stitching operation in order to close an axial end of the tubular manufactured article, said end portion comprising:

an intermediate band connected to said body of the manufactured article;

an end edge thicker than a thickness of said intermediate band;

wherein a height of said intermediate band, proximate to regions that constitute lateral ends of two flaps of said end portion to be overlapped in order to stitch the axial end to be closed of the tubular manufactured article, is lower than the height of the remaining part of said intermediate band.

7. The semi-finished tubular manufactured article according to claim 6, wherein said intermediate band is composed of a succession of rows of knitting; a plurality of loops of knitting of at least part of said rows of knitting of the intermediate band, proximate to the regions constituting the lateral ends of the two flaps of said end portion to be overlapped in order to stitch the axial end to be closed of the tubular manufactured article, being shorter than the length of the loops of knitting of the same rows of knitting in the remaining part of said intermediate band.

8. The semi-finished tubular manufactured article according to claim 6, wherein said intermediate band is made of an elastically extensible thread.

9. The semi-finished tubular manufactured article according to claim 6, wherein said intermediate band is made of a second thread that has a smaller diameter than a diameter of a first thread or of a group of first threads of the rows of knitting of the body of the manufactured article which are connected to said intermediate band.

* * * * *